United States Patent [19]

Berkmann et al.

[11] Patent Number: 4,665,626

[45] Date of Patent: May 19, 1987

[54] PROCESS AND DEVICE FOR DRYING OF COATED WORK PIECES THROUGH INFRARED RADIATION

[76] Inventors: Adolf Berkmann, Bismarckstrasse 80, D-7251 Weissach; Walter Veyhle, Flurstr. 12, D-7140 Ludwigsburg/Ossweil, both of Fed. Rep. of Germany

[21] Appl. No.: 793,691

[22] PCT Filed: Feb. 22, 1985

[86] PCT No.: PCT/EP85/00066

§ 371 Date: Oct. 24, 1985

§ 102(e) Date: Oct. 24, 1985

[87] PCT Pub. No.: WO85/03766

PCT Pub. Date: Aug. 29, 1985

[30] Foreign Application Priority Data

Feb. 24, 1985 [DE] Fed. Rep. of Germany ..... 3406789

[51] Int. Cl.[4] ..... F26B 15/00

[52] U.S. Cl. ..... 34/1; 34/4; 34/39; 34/62

[58] Field of Search ..... 34/1, 4, 15, 20, 39, 34/62, 66, 92; 118/641, 642, 643

[56] References Cited

U.S. PATENT DOCUMENTS

| | | | |
|---|---|---|---|
| 2,388,917 | 11/1945 | Hormel | 34/92 |
| 2,419,643 | 4/1947 | Hudson | 219/34 |
| 4,197,657 | 4/1980 | Leino et al. | 34/15 |
| 4,416,068 | 11/1983 | Nilsson et al. | 118/642 |
| 4,535,548 | 8/1985 | Hyde | 118/642 |
| 4,546,553 | 10/1985 | Best | 118/642 |

FOREIGN PATENT DOCUMENTS

| | | |
|---|---|---|
| 1923362 | 11/1970 | Fed. Rep. of Germany . |
| 2731075 | 1/1979 | Fed. Rep. of Germany . |
| 3016437 | 11/1981 | Fed. Rep. of Germany . |
| 248264 | 1/1948 | Switzerland . |
| 1582437 | 1/1981 | United Kingdom . |

*Primary Examiner*—Albert J. Makay
*Assistant Examiner*—David W. Westphal
*Attorney, Agent, or Firm*—Fleit, Jacobson, Cohn & Price

[57] ABSTRACT

The present invention relates to a process for drying coated workpieces, particularly workpieces of irregular shape, by infrared radiation and to an apparatus for carrying out this process. The present invention can be used for drying castings, particularly those having an irregular shape, thin-walled sheet-metal products as well as ceramic and glass products which have been coated with a powder or an electro-dipping varnish or water-soluble or solvent-containing varnishes. According to said process the workpieces are dried by infrared radiation in several zones at a specific temperature, an air flow being provided in the zones and the air being drawn off from one zone. According to the present invention the workpieces are preheated in the first preheating zone. In the second rest zone the infrared radiation is interrupted so that the temperature of the workpieces slightly decreases. In the third reheating zone the workpieces are completely dried by subjecting them once more to infrared radiation while the air is circulated and heat is additionally supplied to the workpieces by convection. The apparatus comprises a casing, wherein infrared emitters having reflectors are disposed in several zones at intervals from the casing walls, the emitters encompassing an irradiation space. The apparatus also has inlet and outlet openings and a means for conveying the workpieces through the casing and a suction device. According to the present invention a rest zone without any infrared emitters is disposed between a preheating zone and a reheating zone. The suction device in the rest zone is so disposed that the air is circulated within the casing.

12 Claims, 2 Drawing Figures

PROCESS AND DEVICE FOR DRYING OF COATED WORK PIECES THROUGH INFRARED RADIATION

Figure 1:
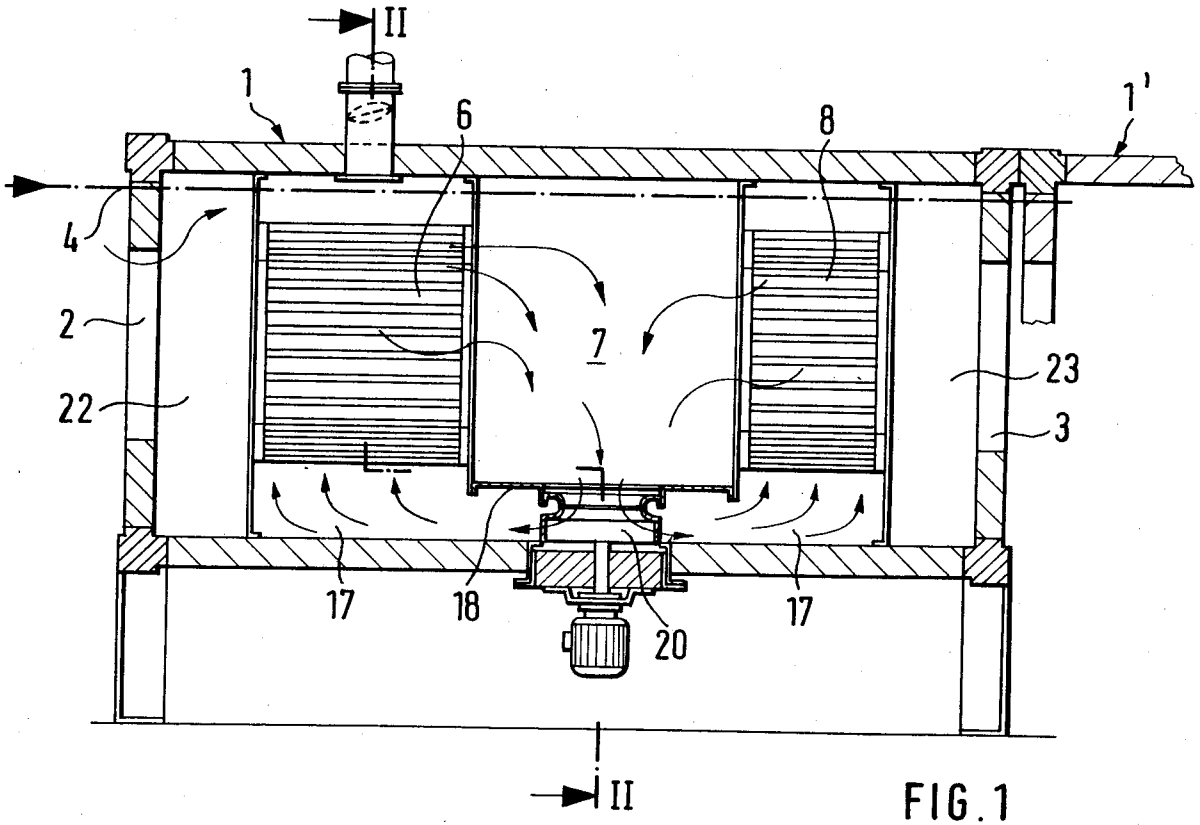

The present invention relates to a process for drying coated workpieces by infrared radiation and to an apparatus for carrying out this process.

The present invention can be used with special advantage for gelatinizing off (drying) powder-coated castings, particularly gray-iron castings including those of irregular shape. However, the present invention can also be applied with special advantage to thin-walled workpieces of complex configuration, as for example, sheet metal workpieces. The coating of the workpieces can be carried out by means of an electro-dipping varnish, a water-soluble varnish or a solvent-containing varnish. Coated workpieces of ceramics or glass can also be dried.

A furnacc in whose casing infrared emitters having reflectors are arranged so as to be spaced from the casing walls are disclosed in U.S. Pat. No. 2,419,643. The infrared emitters enclose an irradiation space. The casing has inlet and outlet openings as well as a means for conveying the workpieces through the casing. On entering the casing the workpieces pass into a zone in which the infrared emitters are disposed closely to each other so that the workpieces can be rapidly heated to the desired drying temperature by the intensive direct irradiation. As the workpieces pass further through the furnace it is only required to maintain the attained drying temperature and for this purpose a lower number of emitters is adequate so that the furnace has a second zone with infrared emitters spaced apart more widely than is the case in the first heating zone.

Means are also provided for producing an air flow through the casing or to draw off air from the central casing portion by a suction device, which can also be used for removing vapour generated during the drying operation.

However, coated castings of irregular shape cannot be dried or treated in this type of furnace since on the one hand burning of the coatings on projecting portions can be observed and on the other hand insufficient drying and treatment results on undercuts and on portions lying in the shadow of the infrared rays can be observed. The convective heat component is thus passed to the atmosphere completely unutilized.

The present invention provides a process by means of which workpieces, particularly workpieces coated with powder or even with liquid varnishes including those of irregular shape and with undercuts can be dried by infrared radiation. The present invention also provides an economical apparatus for carrying out the process.

According to the present invention there is provided in a process for drying coated workpieces by infrared radiation in which the workpieces are dried in several zones at a selected temperature, an air flow being provided in the zones and the air being drawn off from one zone, the improvement in which the workpieces are preheated in the first preheating zone, the infrared radiation is interrupted in the second rest zone so that the temperature of the workpieces slightly decreases and the workpieces are completely dried in the third reheating zone by subjecting them once more to infrared radiation while the air is circulated and additionally gives off heat to the workpieces by convection.

In the first zone and in the third zone the workpieces are heated by the radiation while projecting portions are cooled by the circulated air, excluding overheating. Portions which are irradiated to a lesser degree and can thus absorb less radiation energy are moderately heated. In the rest zone without infrared radiation the heat is equalized within the workpieces. This equalization of heat is enhanced by the air flow circumcirculating about the workpieces in this zone. Because of the equalization of heat in the workpieces the thermal energy required for drying is also supplied to the portions lying in the shadow of the radiation which absorb less radiation energy and the energy applied is thus more economically utilized. Because of the air circulation the reflectors of the emitters and the casing walls can be cooled and the heat absorbed by them can be utilized for treating the workpieces, thus saving energy.

In one desirable embodiment of the present invention there is a slight vacuum in the zones. Suitably infrared radiation is used.

Maintaining a vacuum permits the application of the desired flow conditions for circumcirculating the workpieces and prevents, e.g., dust particles of the powder coating from passing to the outside.

The diffused distribution of infrared rays and the "billiard effect" thus attained makes it possible that undercuts and recesses are also reached and that concentrations on specific projecting portions are avoided, thus contributing to a more homogeneous heating all around.

The present invention also provides an apparatus for drying coated workpieces by infrared radiation, in which the workpieces are dried in several zones at a selected temperature, an air flow being provided in the zones and the air being drawn off from one zone, comprising a casing having a wall, infrared emitters having reflectors disposed in at least two zones spaced from the casing walls, said infrared emitters defining an irradiation space, inlet and outlet openings in said casing, means for conveying the workpieces through the casing, and a suction device, said zones including a preheating zone and a reheating zone between which there is disposed a rest zone without any infrared emitters, said suction device being disposed in said rest zone such that the air is circulated in the casing. Suitably at least the radiation spaces have a variable cross section adaptable to the shape of the workpieces. Preferably at least reflectors disposed parallel to the lateral walls of the casing are adjustable with regard to their angles and spacing relative to the adjacent lateral casing wall.

In a further embodiment of the present invention adjacent reflectors are arranged at a lateral spacing relative to each other, the extent of said lateral spacing being variable.

In a still further embodiment of the present invention the inside walls of the casing consist at least partially of a material which does not absorb the infrared rays.

In a further embodiment of the present invention the reflectors and the inside walls of the casing have a high polish and a three dimensional effective surface.

In another embodiment of the present invention a channel to which a pressure inlet nibble of the suction device is connected is disposed between the inside wall of the casing and the rear of the reflectors. Suitably the rear of the reflectors which bound the channel and the casing wall are adapted to promote a favourable flow. Preferably on the pressure side, the channel has a ventilating outlet which is locakable by a damper.

Figure 2:
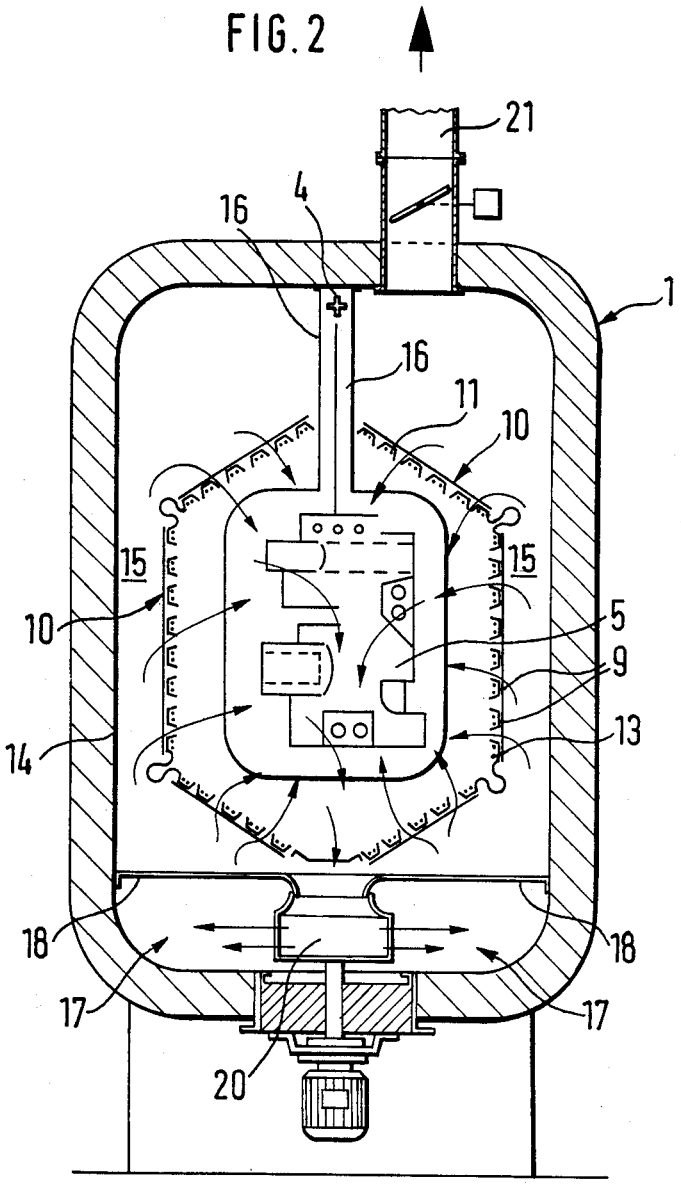

The present invention will be explained hereafter in greater detail by means of a practical example with reference to the accompanying drawings, pointing out variants and further advantages and in which:

FIG. 1 is a diagrammatic longitudinal section of an apparatus for use in the process according to one embodiment of the present invention; and FIG. 2 is a diagrammatic section through the apparatus according to FIG. 1 along the line II—II.

An apparatus for gelatinizing off (drying) powdered castings is used as a practical example.

The apparatus has a conventional tunnel-shaped casing 1 which has an inlet opening 2 and outlet opening 3 on the front and rear ends. A conveying means 4 with which the workpieces 5 coated with varnish can be transported through the apparatus is passed through the inlet and outlet openings 2 and 3 and the casing 1.

The inside of the casing 1 is divided in the longitudical direction into three inter-connected zones 6, 7 and 8, i.e., a preheating zone, a rest zone and a reheating zone. The length of the zones is optional. Since the workpieces are heated to the operating temperature in the preheating zone 6, the latter zone can be longer than or as long as the reheating zone 8. The ratio of the zones 6, 7 and 8 to each other would be, for example 2:2:1, 2:1:1 or 2:1:2 or even 1:1:1. For an extremely complex workpiece 5 having many undercuts and recesses it may be necessary to provide several, when required, shorter rest zones and reheating zones 7 and 8. They can be disposed within the casing 1 (not shown) or in casings 1' (FIG. 1) which can be coupled to the casing 1. These casings 1' can also be so designed to be conveyable.

Enveloping reflectors 9 extending parallel in the conveying direction are disposed in both the preheating zone 6 and the reheating zone 8 in the operating cross section, which depends on the dimensions of the workpieces. The reflectors 9 are at least spaced from the workpiece 5, but preferably at an adjustable angle therefrom and form the walls of the actual irradiation space. Several reflectors 9 can be connected so as to form, or be mounted on, reflector walls 10, 10' arranged in an essentially closed loop with jointly adjustable spaces between them. The shape of the reflector sheathing and thus the cross section of the irradiation spaces depends on the shape of the workpieces 5 and should adapt to the latter's sheath ends. Rectangular arrangements of the reflector walls 10, 10' are also possible. Because of the better possibilities of adaption to different workpieces 5 and with regard to improved diffused ray distribution layouts in the form of a hexagon as in the example shown, or of a triangle, pentagon, etc., are preferable.

In the example shown the lateral reflector walls 10 are in parallel and the upper and lower reflector walls 10' are so arranged that they are movable about an axis 11. When required, the walls 10 can also be so arranged to be parallelly adjustable and at the same time swingable, whereby layouts of pyramidal shape are possible. The reflectors 9 are connected to the reflector walls 10 at a preferably adjustable lateral interval from each other so that there are gaps therebetween, for example, they are slidably, detachably, lockably, and removably disposed on supports (not shown). In this manner the lateral interval and thus the gap between them can easily be increased or decreased. When required, additional reflectors can be secured to the supports (not shown) or removed therefrom so that the irradiation spaces encompassed by the reflectors 9 can be adapted to dimensions of workpieces 5.

The effective side of the reflector 9 is directed to the workpieces 5 and consists of a high-polish layer, for example, of anodized aluminium and is preferably three-dimensional, for example, by pyramids having regular or irregular triangular, tetragonal, pentagonal, hexagonal, etc., bases. The reflectors 9 have the function of distributing the rays of infrared emitters 13 diffusedly in the irradiation space; they must not focus in any way. The infrared emitters 13 are arranged in the axis of individual or of all the reflectors 9. Between the inside wall 14 of the casing 1, the lateral walls of the rest zone 7 and the rear of the reflectors 9 there are disposed channels 15 of different volumes corresponding to the position of the reflector walls 10 in each case. The shape of the walls of the channels 15 is such that it has a favourable effect on the flow in order to assure a homogeneous laminar flow in the channels 15 as nonrotational as possible. The right-hand side and left-hand side channels 15 are separated from each other in the upper region by partitions 16 which enclose the conveying means 4. In the lower region they open out into a common pressure space 17 which is covered from the channels by plates 18 or lattices having openings. The channels 15 on the right- and left-hand side can also be completely separated from each other in the lower region, the pressure space being integrated. The plates 18 or lattices can also be dispensed with.

Suction ports 19 of a fan 20 are disposed on the bottom of the resting chamber 7. The pressure side of the fan 20 is connected to the pressure spaces 17 of the preheating zone 6 and the reheating zone 8.

In the upper closed portion between the partition 16 and the lateral wall of the casing, the channels 15 have ventilating outlets 21 provided with dampers. The ventilating outlets 21 serve for controlling the temperature of the atmosphere inside the apparatus and when required for drawing off vapours.

The described layout of the reflectors 9 protects the furnace inside wall therebehind from direct radiation and said wall is also cooled by the flow conditions produced. The reflectors are also protected against the deposit of cleavage and cracking products by the flow conditions attained.

The wall of the casing 1 of the rest zone 7 and also in the inlet zone 22 located between the inlet opening 2 and the preheating zone 6 as well as in the outlet zone 23 between the reheating zone 8 and the outlet opening 3 preferably consists of a material which practically does not absorb the infrared radiation. This wall, like the reflectors, can consist of a high-polished layer, for example, anodized aluminium, and can also be three dimensional. Infrared rays straying through the casing because of the billard effect can be directed back to the workpiece and, in association with the air flow, any noteworthy heating of the wall is avoided, making special insulation unnecessary.

The process according to the present invention proceeds in the apparatus described as follows:

Prior to starting the apparatus the spacing of the reflectors 9 and of the reflector walls 10, 10' corresponding to the size of the treated workpiece 5 and the optimal effective distance of the infrared emitters 13 used are adjusted. Corresponding to the shape and condition of the workpiece 5 as well as to the required amount of heat depending thereon the number, the distribution and the type of the infrared emitters 13 are selected and correspondingly also the spaces between the reflectors 9. When identical or similar articles are subjected to the treatment this adjustment is made only once on starting the apparatus. It has been found that medium-wave infrared emitters having a wavelength of λ 2 to 3 are particularly suitable.

Some of the infrared emitters 13 (or all of them) are provided with reduced power and the fan 20 is then switched on. The unloaded idling temperature required is thus adjusted inside the apparatus. Because of the arrangement of the fan 20 a vacuum is obtained in the rest zone 7 as well as in the irradiation spaces of the preheating and reheating zones 6 and 8 while an excess pressure is building up in the channels. A flow from the channels 15 which flows around the reflectors 9 into the irradiation spaces and around the workpieces 5 into the rest zone 7 is thus formed. The reflectors 9 are cooled by this flow and components of the convective heat are obtained for the treatment of the workpieces 5. The direction of the flow is indicated in the Figures by arrows.

When the arrival of a workpiece 5 is indicated by a signal, the infrared emitters 13, piloted by a pilot emitter, are increased and attain their standard power when the workpiece 5 enters the irradiation space of the preheating zone 6. Because of type and arrangement of the reflectors 9 the radiation of the infrared emitters 13 is diffusedly distributed and thus also partially reflected by other reflectors 9 before it reaches the workpiece 5. Because of these reflections undercuts and recesses which would be in the shadow in the case of a straight-lined path of rays can also be reached. Because of this and because of the circumcirculation mentioned above a more uniform heating results. The workpiece 5 then passes into the rest zone 7 which has no infrared emitter. Not only is no heat supplied in this zone but slight cooling of the surface is provided by the air flow so that the heat absorbed by the surface region can flow off to the inside and acts within the workpiece like an equilization of temperature within the workpiece between thick-walled and thin walled portions. Any possible burning due to the temperature and pressure thus is effectively forestalled. Furthermore, there occurs a heat flow from the inside into the zones, where the radiation could not reach the surface or reached it only to a minor extent so that the quality of the treatment is also improved. In the reheating zone 8 a final treatment is carried out; it corresponds to the treatment carried out in the preheating zone 6. On leaving the reheating zone 8 the treatment of the workpiece 5 is completed, i.e., the coating has been completely hardened in a high-grade manner. In the case of very complex workpieces 5 several resting and reheating treatments, the times of which are shortened when required, can be carried out when needed.

The present invention will be further illustrated by way of the following example.

EXAMPLE

An apparatus of the type described above was mounted with medium-wave twin-tube IR-quartz emitters, having octagonal-shaped cross sections, their rears being covered with a gold layer, and with reflectors having a three dimensionally structured reflector surface of high-polish anodized aluminium.

The lateral spacing between adjacent reflectors was 15 mm and that between the central axes of the infrared emitters was 65 mm. The power per unit surface was between 30 and 36 kw per square meter. The unloaded, idling power was 10% of the full power. Powder-coated castings, for example, of gray cast iron, (some of them having a complex shape) were passed through the apparatus at a rate of 1 meter per minute without rotating the workpiece. In the example the workpieces remained for two minutes in the preheating zone, 1 minute in the rest zone and from 1 to 1.5 minutes in the reheating zone. After 2 minutes fusing of the powder on the sides directly turned towards the emitters could be observed. At this instant the rest zone should be reached. The temperature in both the preheating zone and the reheating zone was limited to 200° C. For short-term adjustment air can also be removed by the ventilating outlet 21 requiring more intense drawing in of atmosphere air thorugh the inlet and outlet openings 2, 3. In the irradiation spaces and in the rest zone 7 a slight vacuum of approximately 10 Pa was maintained and in the channels 15 a slight excess pressure of 500 Pa. Because of the flow obtained and the omission of the infrared emitters the temperature in the rest zone was lower by approximately 30° C.

On leaving the apparatus and on cooling the coated workpieces 5 they had homogeneously dried high-grade coatings.

In conventional drying processes, which are suitable for workpieces of gray cast iron having irregular shapes, a total residence time of 40 to 45 minutes is required for the same workpieces.

The embodiments of the invention in which an exclusive property or privilege is claimed are defined as follows:

1. An apparatus for drying of particularly powder-coated workpieces by infrared radiation, in which the workpieces are dried in several zones at a selected temperature and an air flow is provided in the zones, comprising a casing having walls and in which, in several zones spaced from the casing walls adjustable infrared emitters and reflectors are arranged encompassing respective irradiation spaces, inlet and outlet openings in said casing, conveying means for conveying the workpieces through the casing, and a suction device, said zones including a preheating zone and a reheating zone having respective ones of said infrared emitters and reflectors arranged therein, and a resting zone without any infrared emitters arranged between said preheating zone and said reheating zone, said suction device being arranged in said resting zone such that the air is circulated within the casing, and said reflectors having a high polish and a three dimensional structured effective surface.

2. An apparatus according to claim 1, in which the irradiation spaces encompassed by said adjustable infrared emitters and reflectors have a variable cross section adaptable to the shape of the workpieces.

3. An apparatus according to claim 2, in which at least reflectors disposed parallel to lateral walls of the casing are adjustable with regard to their angles and spacing relative to a respective adjacent lateral casing wall.

4. An apparatus according to claim 1, 2 or 3, in which adjacent reflectors are arranged at a lateral spacing relative to each other, the extent of said lateral spacing being variable.

5. An apparatus according to claim 1, in which a channel to which a pressure inlet nibble of the suction device is connected is disposed between the inside wall of the casing and the rear of the reflectors.

6. An apparatus according to claim 5, in which the rear of the reflectors which bound the channel and the casing wall are adapted to promote a homogeneous laminar and nonrotational flow.

7. Apparatus particularly adapted for drying irregular workpieces having projecting and undercut portions, comprising: a casing having an inlet end and an outlet end; a preheating zone, rest zone and reheating zone sequentially arranged in said casing between said inlet end and said outlet end; conveyor means for conveying the workpieces through said preheating, rest and reheating zones in sequence; infrared emitters and reflectors mounted in each of said preheating and reheating zones for irradiating the workpieces in said zones, said rest zone containing no infrared emitters so as to permit heat absorbed by the workpieces in said preheating zone to equalize within the workpieces and dry the undercut portions thereof; means located in said rest zone for circulating air through said preheating, rest and reheating zones to facilitate equalization of heat in the workpieces, prevent overheating of projecting portions of the workpieces and enhance drying of the undercut portions of the workpieces, said air circulating means also including suction means for enhancing the air circulation through said preheating, rest and reheating zones.

8. Apparatus according to claim 7, wherein said reflectors have a high polish and a three dimensional structured effective surface.

9. Apparatus according to claim 8, wherein said infrared emitters and reflectors are mounted on a plurality of adjustable walls arranged in closed loops to define respective irradiation spaces in said preheating and reheating zones, said walls being movable into various configurations to accommodate different sizes and enhance irradiation of the workpieces.

10. Apparatus according to claim 9, wherein lateral ones of said infrared emitter and reflector mounting walls and lateral ones of said walls of said casing in each of said preheating and reheating zones define side channels, and said air circulating means is a combination air circulating-suction device mounted in a lower portion of said rest zone for producing relatively high pressure homogeneous laminar air flow in said side channels and a relatively lower pressure in said irradiation spaces and said rest zone.

11. Apparatus according to claim 7, wherein said infrared emitters and reflectors are mounted on a plurality of adjustable walls arranged in essentially closed loops to define respective irradiation spaces in said preheating and reheating zones, said walls being movable into various configurations to accommodate different sizes and enhance irradiation of the workpieces.

12. Apparatus according to claim 11, wherein lateral ones of said infrared emitter and reflector mounting walls and lateral ones of said walls of said casing in each of said preheating and reheating zones define side channels, and said air circulating means is a combination air circulating-suction device mounted in a lower portion of said rest zone for producing relatively high pressure homogeneous laminar air flow in said side channels and a relatively lower pressure in said irradiation spaces and said rest zone.

* * * * *